United States Patent [19]

Norden

[11] Patent Number: 4,714,434

[45] Date of Patent: Dec. 22, 1987

[54] TERMINAL BLOCK WITH CIRCUIT MARKER

[76] Inventor: Alexander R. Norden, 350 Central Park West, New York, N.Y. 10025

[21] Appl. No.: 826,584

[22] Filed: Feb. 6, 1986

[51] Int. Cl.[4] ..... H01R 9/24

[52] U.S. Cl. ..... 439/488; 439/709; 439/712

[58] Field of Search ..... 339/113 B, 113 R, 113 L, 339/198 R, 198 J, 198 G, 198 GA

[56] References Cited

U.S. PATENT DOCUMENTS

| | | | |
|---|---|---|---|
| 2,671,888 | 3/1954 | Hadden et al. | 339/198 J |
| 2,848,703 | 8/1958 | Foote et al. | 339/113 B |
| 2,856,570 | 10/1958 | Peck | 361/433 |
| 3,123,425 | 3/1964 | Blanchet | 339/113 B |
| 3,253,251 | 5/1966 | Norden | 439/716 |

FOREIGN PATENT DOCUMENTS

| | | | |
|---|---|---|---|
| 1952088 | 4/1971 | Fed. Rep. of Germany | 339/113 B |
| 1765422 | 7/1971 | Fed. Rep. of Germany | 339/113 B |
| 1261289 | 4/1960 | France | 339/113 B |

*Primary Examiner*—Gil Weidenfeld
*Assistant Examiner*—Thomas M. Kline

[57] ABSTRACT

The exemplary terminal block has pairs of wire fasteners distributed in two rows, and a circuit identifier bearing circuit labels corresponding to the pairs of wire fasteners; the circuit identifier is shiftable side-to-side on the terminal block so as to overlie a selected row of wire fasteners, the other row being accessible for operation.

8 Claims, 8 Drawing Figures

TERMINAL BLOCK WITH CIRCUIT MARKER

This invention relates to multiple-circuit electrical terminal blocks having means for labeling their circuits.

BACKGROUND OF THE INVENTION

Terminal blocks typically comprise a block of insulation bearing a series of circuit connecting devices. A terminal block may consist of a row of separate modular units, or a single unitary structure may be used. The terms "terminal block" and "a support of insulation" as used herein refer to both forms of construction.

The connecting devices of a terminal block connect a first series of wires to a corresponding second series of wires, each connecting device and the wires it interconnects being called "a circuit". It is common to label the circuits, as an aid to technicians in connecting the wires initially and in providing service subsequently.

Circuit-identifying labels are sometimes adhered to the inside of a hinged door or panel which, when in its "open" position, provides circuit-identifying marks aligned with respective wiring terminals. With the door open, the labels are positioned to one side of the terminals. For more direct identification of the circuits it is common to mount marking strips directly on the terminal blocks. In one form, the marking strip is applied along an area of a terminal block between two rows of wire fasteners. It may be necessary to make the terminal block wider than it would ordinarily be in order to provide space for the marking strip. More compact terminal blocks that do not have a free space for mounting a terminal strip can still be marked, by providing a special form of marking strip that is applied to the terminal block over an area where screws of the connecting devices are distributed. The marking strip has punched holes for access to the screws. The areas of the marking strip between the holes is used for circuit-identifying characters.

SUMMARY OF THE INVENTION

This invention relates to terminal blocks of the type having wire fasteners that are operated from the top of the block. Wires ordinarily reach the connecting devices from the sides of the terminal block. Wire fasteners of the connecting devices may be distributed as two straight rows or as two rows of staggered wire fasteners, for the two sets of wires that are to be interconnected.

The novel terminal blocks include a circuit identifier for carrying the circuit labels, disposed in position over one row of wire fasteners of a terminal block while leaving the other row of wire fasteners accessible for operation. The circuit identifier is shiftable into position over the wire fasteners that are initially exposed, in order to expose the initially covered row of wire fasteners. The circuit-identifying labels on the circuit identifier remain exposed and in alignment with the respective circuits of the terminal block. The area of the label available for each circuit is quite wide, being uninterrupted by access holes for reaching wiring devices. The terminal block can be made compact, consistent with its circuit-connecting function, i.e., terminal blocks need not be made especially wide to allow a discrete space for a marking strip.

The circuit identifier is supported for side-to-side shifting out of position over one row of wire fasteners and into position over the other row. In this way, one row or the other of fastening devices is accessible for securing or releasing a set of wires. The space required for the terminal block equipped with the shiftable circuit identifier can be limited to the same space as is needed for the terminal block alone. Each circuit-identifying label is always exposed for use and remains immediately adjacent to its related connecting device. By shifting the circuit identifier, both rows of wire fasteners are accessible to be operated.

In the exemplary embodiment of the invention described in detail below and shown in the accompanying drawings, the circuit identifier slides on the terminal block. The parts are held in assembly to each other by complementary slide guides on the circuit identifier and the terminal block. Cooperating stops limit the sliding motion, preventing the circuit identifier from sliding off the terminal block. Each circuit-identifying label remains aligned with both wire fasteners of the related connecting device.

Other means for mounting the circuit identifier so that it can be shifted side-to-side may be provided, as by supporting the circuit identifier on a pair of arms pivoted about an axis that is below the terminal block and parallel to the rows of wire fasteners. However, the illustrative construction detailed below has distinct advantages.

In the exemplary terminal blocks described in detail below, the wire fasteners are screw-operated clamps, the heads of the screws being slotted for operation by a screwdriver. Of course, screw heads for screw clamps may also be formed for operation by a socket wrench or an Allen wrench; and wire fasteners for use here could take various forms, a simple screw for example, or a screwless pressure-releasable gripper. The term "wire fastener" is used to refer to any of a wide range of suitable devices that require manipulation for holding or releasing wires.

The nature of the invention including the foregoing and other novel features and advantages will be more fully appreciated from the following detailed description of the presently preferred embodiment that is shown in the accompanying drawings.

DESCRIPTION OF THE ILLUSTRATIVE EMBODIMENT

Figure 1:
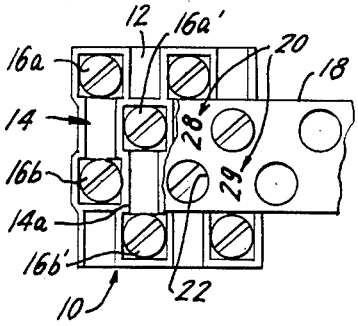
FIGS. 1 and 2 are fragmentary top plan views of two different forms of presently commercial terminal blocks equipped with circuit-identifying marking strips.

FIG. 1 shows commercial terminal block 10 having insulation 12 containing a series of connecting devices 14. Each connecting device extends transverse to the length of the terminal block. The insulation, in practice, consists of a series of modular molded parts each containing four connecting devices 14. Each connecting device includes a conductor 14*a* and a pair of wire fasteners 16*a* and 16*b* or 16*a'* and 16*b'* at its ends. For providing an increased number of connecting devices for any particular length of the terminal block, without reducing the dimensions of the connecting devices, connecting devices 14 are staggered. The wire fasteners 16*a* and 16*a'* of successive connecting devices 14 are staggered, as are wire fasteners 16*b* and 16*b'*. The row of wire fasteners 16*a*, 16*a'* is located above the center line of the terminal block (as seen in the drawing) and the row of wire fasteners 16*b* and 16*b'* is below the center line.

A circuit marking strip 18 extends along the terminal block for providing circuit-identifying markings 20 aligned with the respective connecting devices 14. Strip 18 has holes 22 through which a screw driver can reach wire fasteners 16*a'* and 16*b* of connecting devices 14.

Figure 2:
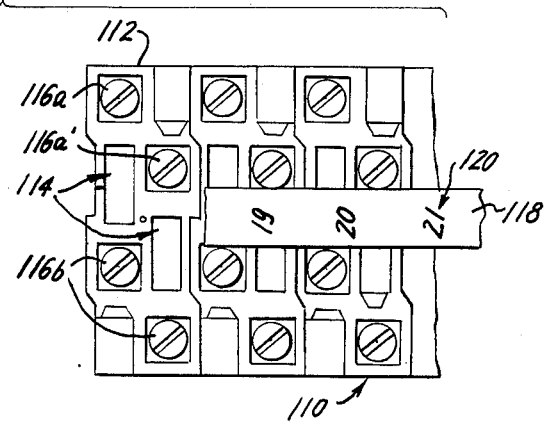

FIG. 2 shows another commercial terminal block, more specifically an assembly of modular terminal block units similar to FIG. 1. The parts in FIG. 2 bear numbers of the "100" series corresponding to like parts in FIG. 1, so that their description need not be repeated. Wire fasteners 116*a'* and 116*b* are spaced apart (vertically in the drawing) far enough to provide space for marking strip 118 with its circuit identifications 120.

The space available for circuit-identifying characters in both FIGS. 1 and 2 is quite limited, considering the dimensional constraints of these commercial terminal blocks. It is possible to use four digits in the construction of FIG. 1 for identifying each circuit, but the characters are tiny and therefore not easy to read.

FIGS. 3–10 illustrate a terminal block 30 largely of the same construction as in FIG. 1, bearing a circuit identifier 40. The terminal block in FIGS. 3–10 includes a one-piece body of insulation 32 containing a series of conventional connecting devices similar to connecting devices 14 in the terminal block of FIG. 1. Each connecting device includes a conductor 34*a* and wire fasteners at its extremities. The wire fasteners are distributed in two staggered rows at opposite sides of the vertical center line in FIG. 3. One row, to the right of the center line, includes wire fastener 36*a* of the first connecting device and other wire fasteners 36*a'*, 36*a*, etc. Similarly, wire fasteners 36*b*, 36*b'*, 36*b*, etc. form a second staggered row to the left of the vertical center line in FIG. 3. In practice, wire fasteners 36*a'* and 36*b* may each encroach a bit across the center line, but the screws are engageable by a screw driver at opposite sides of the center line.

Figure 5:
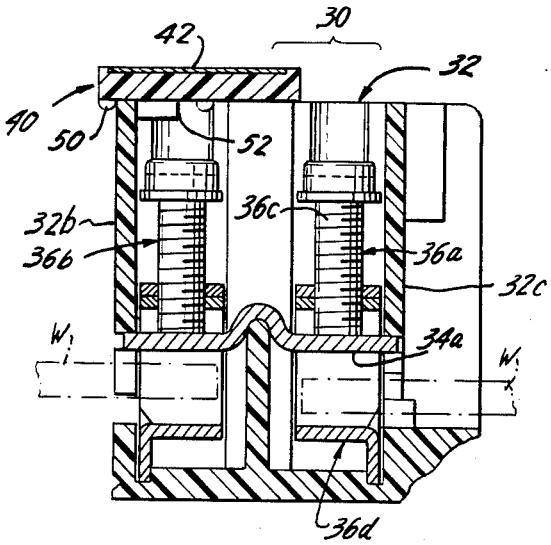
FIG. 5 is a fragmentary cross-section of the assembly of FIGS. 3 and 4 as seen at the plane 5—5 of FIG. 3, drawn to larger scale.
Figure 7:
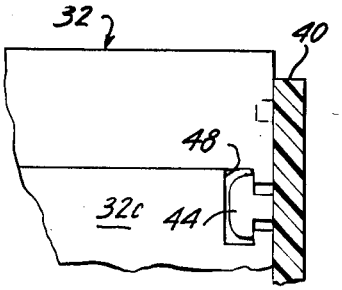
FIG. 7 is a fragmentary elevation of the assembly of FIGS. 3–5 as seen at the plane 7—7 in FIG. 3, drawn to larger scale.

As best seen in FIG. 5, each connecting device includes conductor 34*a*, a strip of copper that is fixed in position in the insulator 32; wire fastener 36*a* or 36*a'*; and wire fastener 36*b* or 36*b'*. Each wire fastener includes a screw 36*c* and a four-walled metal clamping collar 36*d*. The screw is threaded through the double-thickness top wall of the collar and bears on conductor 34*a*, drawing the bottom wall of the collar toward conductor 34*a* for gripping the wire against conductor 34*a*. The side walls of four-wall clamp 36*d* are vertical and spaced apart. Wire W enters the space between the clamping collar's side walls. These screws have slotted heads for operation by a screw driver and the screws are upright, their axes being parallel to each other and perpendicular to the top of insulator 32.

Wires W enter openings 32*a* in body 32 of insulation. These openings are formed in faces 32*b* which effectively form the opposite sides of body 32 and in recessed faces 32*c* that alternate with faces 32*b* along body 32. This configuration results from staggering of the connecting devices and their wire fasteners.

The bottom of terminal block 30 has formations (not shown) for mating with various forms of mounting hardware. Various mounting arrangements are well known and need not be described.

Figure 3:
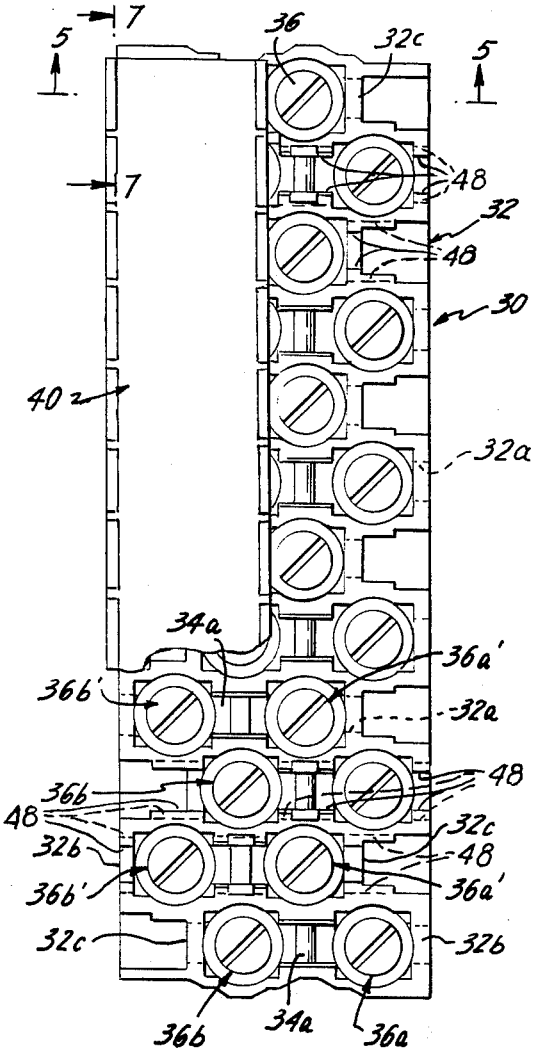
FIG. 3 is a top plan view of a terminal block bearing a circuit identifier, as an embodiment of the invention.
Figure 4:
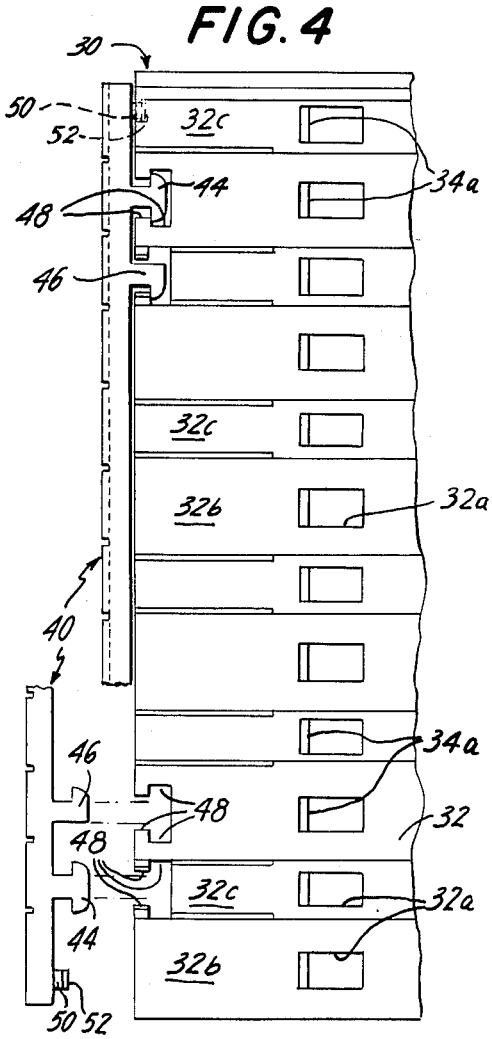
FIG. 4 is a fragmentary elevation of the assembly of FIG. 3 as seen from the right.

The terminal block of FIGS. 3–10 includes a circuit identifier 40, being a one-piece part of molded insulation having a shallow recess in its upper surface to contain a series of individual circuit labels or a continuous marking strip 42 (FIG. 5). In the position of FIGS. 3 and 5, circuit identifier 40 covers the left-hand row of wire fasteners 36*b* and 36*b'*. Wire fasteners 36*a* and 36*a'* forming a staggered row at the right are exposed and accessible for operation by a screw driver from the top of the assembly. The space at the top of circuit identifier directly opposite to each wire fastener, roughly half as wide as the terminal block, is available for circuit-identifying characters. In practice, a row of four or more easily read characters can be inscribed opposite each connecting device.

Figure 6:
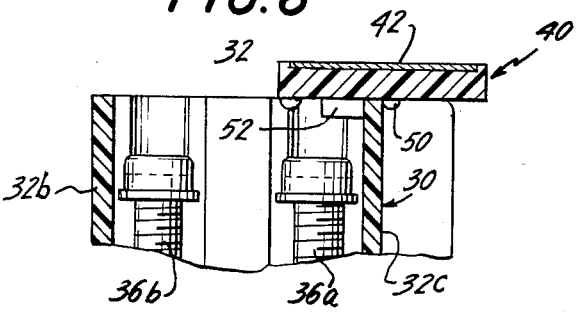
FIG. 6 is a fragmentary view of the assembly of FIG. 5 with a changed relationship of the parts.
Figure 8:
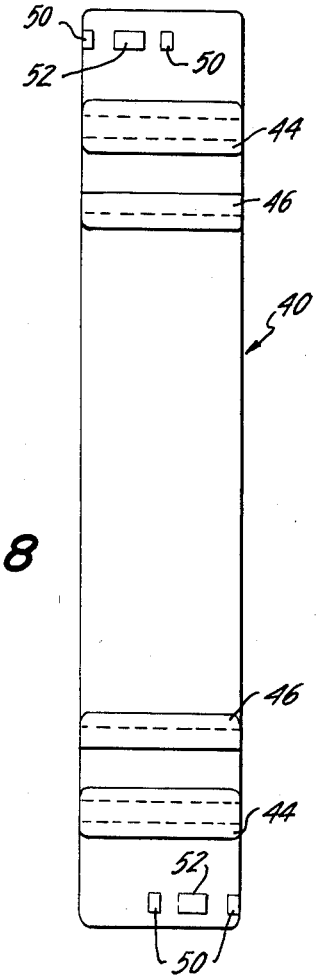
FIG. 8 is a bottom plan view of the circuit identifier 40 of FIGS. 3–7, being a component of the assembly of FIGS. 3–7.

Circuit identifier 40 can be shifted from the position of FIG. 5 and across the top of terminal block 30 into position over the right-hand row of wire fasteners 36*a* and 36*a'*, as represented in FIG. 6. In its new position, circuit identifier 40 is clear of the staggered row of wire fasteners 36*b* and 36*b'*, which are then accessible for operation from above by a screw driver.

As seen in FIGS. 4–7, circuit identifier 40 has transverse rails 44 of T-shaped cross-section and transverse rails 46 of L-shaped cross-section near its opposite ends, projecting from its lower surface. Those rails mate with complementary formations 48 (FIGS. 3, 4 and 7) in opposite side wall portions 32*b* and 32*c* that are staggered along body 32 and in other portions of the top of molded body 32 of insulation. At each of its ends, circuit identifier 40 also has a pair of detents 50 and a stop 52 between each pair of detents. These detents are small cylindrically rounded projections. Stops 52 are higher than detents 50, and stops 52 have flat shoulders, perpendicular to the lower face of circuit identifier 40 which slides on the top of insulation block 32.

When circuit identifier 40 is located in either of the positions of FIG. 5 or FIG. 6, it is held in position by cooperation of each stop 52 and one detent 50 with a wall 32*b* or 32*c*, at each end of body 32. As an incidental detail, the groups of two detents 50 and one stop 52 at the opposite ends of member 40 (FIG. 8) are offset in relation to each other, as shown, because those formations cooperate with correspondingly related wall portions 32*b* and 32*c* of body 32 of insulation.

When circuit identifier 40 is to be shifted from one position to the other (the positions of FIGS. 5 and 6) it is first necessary to overcome the limited restraint developed by the detents 50 in cooperation with insulating walls 32*b* and 32*c* at the ends of body 32. The materials of body 32 and member 40 are sufficiently resilient for this release to occur when only a modest amount of force is applied. Correspondingly, the shift of member 40 to its new position requires enough force to shift detents 50 across walls 32*b* and 32*c* of body 32 at the ends of the assembly. The sliding stroke of member 40 in either direction is firmly limited by stops 52.

When circuit identifier 40 is first assembled to body 32, it is placed on body 32 and it is then forced downward. Rounded margins of guides 44 of T-shaped cross-section act as cams to spread the guiding formations of body 32. The material of body 32 (nylon, for example) is sufficiently resilient for this action. Member 40 is also of resilient material so that the guides 46 of L-shaped cross-section are capable of tilting distortion as member 40 is forced downward. When the assembly has been completed, the resilience of the parts causes restoration of the shapes as shown, and member 40 remains in securely retained assembly to body 32, and stops 52 are between the opposite side walls 32*b* or 32*b'* and 32*c* or 32*c'*.

Circuit identifier 40 is approximately half the width of insulating body 32, thus providing an unusual amount of spac for inscription of large and easily read circuit identifying characters. In a practical example, there is ample space for four or more relatively large characters for each circuit. In shifting from side to side, circuit identifier 40 need not project significantly beyond the sides of body 32. Accordingly, its stroke is unimpeded by structure that may be close to the terminal block in an assembly.

Circuit identifier 40 may be made equal to the entire width of the insulating block 32, to serve as a dust cover. In that construction, three detented positions of a double-width member 40 may be provided, two positions in which first one and then the other row of wire fasteners is exposed and a third detented position in which the double-width circuit identifier overlies both rows of wire fasteners. When in position to expose either row of wire fasteners, the modified circuit identifier would project or overhang substantially beyond one side or the other of the body 32. Space would be needed in the installation to accommodate such overhang. In each instance—the illustrated construction and the alternative—the circuit identifying characters on the circuit identifier remain exposed and aligned with the related connecting devices in all of the selective positions of the circuit identifier.

The presently preferred form of the novel terminal block is amenable to not only the modifications noted above, but also to other changes and applications. Consequently, the invention should be construed broadly in accordance with its true spirit and scope.

What is claimed:

1. A multiple-circuit terminal block, including a series of connecting devices each of which has first and second wire fasteners, a support essentially of electrical insulation having opposite first and second sides and having a top extending side-to-side, and a circuit identification member, said connecting devices being carried by said support and being spaced apart from each other along the support, the first and second wire fasteners of each connecting device being spaced apart and being aligned with each other side-to-side on said support, said wire fasteners being disposed for manipulation by a tool from above said support, the first wire fasteners and the second wire fasteners of said connecting devices being distributed in a first row and in a second row, respectively, along said support, said circuit identification member and said support having mutually complementary guiding formations disposing the circuit identification member above the support and constraining said circuit identification member to slide side-to-side so as to overlie selectively each of said rows of fastening devices while exposing the other of said rows of wire fastening devices for manipulation, portions of said circuit identification member being aligned with said connecting devices, respectively, and having areas exposed to view for bearing circuit-identification marks whereby such circuit identification marks are and remain aligned with said connecting devices, respectively, as the circuit identification member is shifted side-to-side.

2. A multiple-circuit terminal block as in claim 1 wherein said rows of wire fasteners include rows of screws whose axes are perpendicular to the top of the support.

3. A multiple-circuit terminal block as in claim 1 wherein said wire fasteners are screw-operated clamps having screws whose axes are perpendicular to the top of the support.

4. A multiple-circuit terminal block as in claim 1 wherein said wire fasteners are screw-operated clamps having screws whose axes are perpendicular to the top of the support, and wherein the width of said circuit identification member is approximately half the width of the top of said support.

5. A multiple-circuit terminal block as in claim 1 wherein said support of insulation and said circuit identification member have mutually cooperable stop means for limiting shift of the circuit identification member side-to-side on said support to either of two discrete positions, in which the circuit identification member exposes one row of said wire fasteners for manipulation and overlies said other row of wire fasteners.

6. A multiple-circuit terminal block as in claim 1 wherein said circuit identification member is a member whose width is approximately half the width of the top of said support and does not project beyond the sides of said support in sliding side-to-side for exposing either of said rows of wire fasteners.

7. A multiple-circuit terminal block as in claim 1 wherein said support and said circuit identification member have mutually cooperable stop means for limiting sliding of the circuit identification member side-to-side on said support to either of two discrete positions in which it is clear of one row of wire fasteners and overlies the other row of wire fasteners, and wherein the width of said circuit identification member is approximately half the width of the top of said support and is restricted by said stop means so that it does not project substantially beyond the sides of the support in either of said discrete positions.

8. A multiple-circuit terminal block as in claim 7 wherein said wire fasteners are screw-operated clamps having screws whose axes are perpendicular to the top of the support.

* * * * *